US011185873B2

(12) United States Patent
Su et al.

(10) Patent No.: US 11,185,873 B2
(45) Date of Patent: Nov. 30, 2021

(54) ASSEMBLED SHOWER DEVICE

(71) Applicant: Runner (Xiamen) Corp., Xiamen (CN)

(72) Inventors: Wei-Wu Su, Xiamen (CN); Min-Qing Zheng, Xiamen (CN); Zhao-Yi Zhuo, Xiamen (CN); Tai-Hua Chen, Xiamen (CN); Sheng-Jun Du, Xiamen (CN)

(73) Assignee: RUNNER (XIAMEN) CORP., Xiamen (CN)

( * ) Notice: Subject to any disclaimer, the term of this patent is extended or adjusted under 35 U.S.C. 154(b) by 128 days.

(21) Appl. No.: 16/740,815

(22) Filed: Jan. 13, 2020

(65) Prior Publication Data

US 2020/0238306 A1 Jul. 30, 2020

(30) Foreign Application Priority Data

Jan. 24, 2019 (CN) ..... 201920122441.7

(51) Int. Cl.
*B05B 1/18* (2006.01)
*B05B 1/16* (2006.01)

(52) U.S. Cl.
CPC ..... *B05B 1/185* (2013.01); *B05B 1/1609* (2013.01)

(58) Field of Classification Search
CPC ..... B05B 1/185; B05B 15/62; B05B 15/652; B05B 1/1663; B05B 1/1609; B05B 1/18; E03C 1/06; E03C 1/0408
See application file for complete search history.

(56) References Cited

U.S. PATENT DOCUMENTS

2012/0325353 A1* 12/2012 Zhou ..... B05B 1/1618 137/625
2018/0104707 A1* 4/2018 Lin ..... E03C 1/06

* cited by examiner

*Primary Examiner* — Qingzhang Zhou
(74) *Attorney, Agent, or Firm* — Chun-Ming Shih; HDLS IPR Services

(57) ABSTRACT

Disclosed is an assembled shower device, that includes a hand-held type shower and a head portion shower. In the head portion shower is disposed a control mechanism. The control mechanism is adapted to control open or close of a water channel of the hand-held type shower, such that the hand-held type shower and the head portion shower act in cooperation in the following two approaches: the hand-held type shower is disposed on the head portion shower, to bring the control mechanism into action, to close the water channel of the hand-held type shower; and the hand-held type shower is separated from the head portion shower, to bring the control mechanism into action, to open the water channel of the hand-held type shower.

4 Claims, 9 Drawing Sheets

ASSEMBLED SHOWER DEVICE

BACKGROUND OF THE INVENTION

Field of the Invention

The preferred embodiment of the present invention relates to a shower, and in particular to an assembled shower device.

The Prior Arts

Shower device is used extensively in our daily life for taking a shower, in particular the lover's shower device provides extraordinary showering experience and satisfaction, and is widely welcomed. However, for the existing lover's shower device, water switching has to be performed manually, to cause inconvenience for the user in application.

Therefore, presently, the design and performance of the shower device is not quite satisfactory, and it leaves much room for improvements.

SUMMARY OF THE INVENTION

In view of the problems and drawbacks of the prior art, the preferred embodiment of the present invention provides an assembled shower device, to overcome the shortcomings of the prior art.

The present invention provides an assembled shower device, that includes a hand-held type shower and a head portion shower. In the head portion shower is disposed a control mechanism. The control mechanism is adapted to control open or close of a water channel of the hand-held type shower, such that the hand-held type shower and the head portion shower act in cooperation in the following two approaches: the hand-held type shower is disposed on the head portion shower, to bring the control mechanism into action, to close the water channel of the hand-held type shower; and the hand-held type shower is separated from the head portion shower, to bring the control mechanism into action, to open the water channel of the hand-held type shower.

In an aspect of the present invention, the control mechanism includes a first switching component and a first magnetic element disposed in the head portion shower, and a second magnetic element is disposed at one end of the hand-held type shower, such that the first magnetic element and the second magnetic element are made to separate apart or move close, to bring the first switching component to open or close the water channel of the hand-held type shower.

In another aspect of the present invention, the head portion shower further includes an outer shell, a fixing seat, and a water outlet element, the fixing seat and the control mechanism are disposed in the outer shell. The fixing seat includes a bottom seat and a main body, and the main body is provided with an insertion slot. The first magnetic element is disposed at a position of the main body near the insertion slot, and the second magnetic element is disposed at one end of hand-held type shower near the insertion slot.

In yet another aspect of the present invention, in the main body is disposed a water inlet channel, a first water outlet channel, and a second water outlet channel. The first water outlet channel is connected and in communication with the hand-held type shower, and the second water outlet channel is connected and in communication with the water outlet element.

In a further aspect of the present invention, the first switching component includes a first switching valve cartridge, a transmission rod, a push piece, and an elastic piece. The first switching valve cartridge is disposed between water inlet channel and the first water outlet channel, and the transmission rod is disposed near the first magnetic element and is rotatable around the main body. One side of the transmission rod is leaned against on the first switching valve cartridge, and one end of the elastic piece is leaned against on the main body, while the other end of the elastic piece is leaned against on the push piece. The push piece is disposed on the bottom seat, and the push piece is made to move reciprocally under action of the elastic piece and the transmission rod.

In an aspect of the present invention, a protrusion piece is disposed on the transmission rod, and the protrusion piece act in cooperation with the push piece.

In another aspect of the present invention, a guide rail is disposed at a bottom of the push piece, and on the bottom seat is disposed a rail acting in cooperation with the guide rail.

In yet another aspect of the present invention, on the bottom seat is disposed a rotatable first switching rod, the first switching rod 44 and the transmission rod are disposed opposite to each other, and are both disposed on a back side of the push piece.

In a further aspect of the present invention, the assembled shower device further includes a second switching component, the second switching component includes a second switching valve cartridge, a second switching rod, and a push button. The second switching valve cartridge is disposed between the water inlet channel and the second water outlet channel. The second switching rod is disposed on the bottom seat, with one end of the second switching rod leans against on the second switching valve cartridge. The push bottom is connected to the second switching rod. When the push button is pressed, it brings the second switching rod into rotation.

In the present invention, for the assembled shower device, the hand-held type shower can be placed onto or taken off the head portion shower, to control water to output from the hand-held type shower automatically, without the need for the user to handle it manually. As such, the design of the present invention is capable of simplifying operations and applications, and increasing user's satisfaction. Moreover, in the present invention, a push button is provided, to enable water output from the head portion shower, hereby providing enormous convenience to the user.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from this detailed descriptions.

BRIEF DESCRIPTION OF THE DRAWINGS

Embodiments of the present invention are described below, by way of example only, with reference to the accompanying drawings; in which.

DETAILED DESCRIPTION OF THE PREFERRED EMBODIMENT

Figure 1:
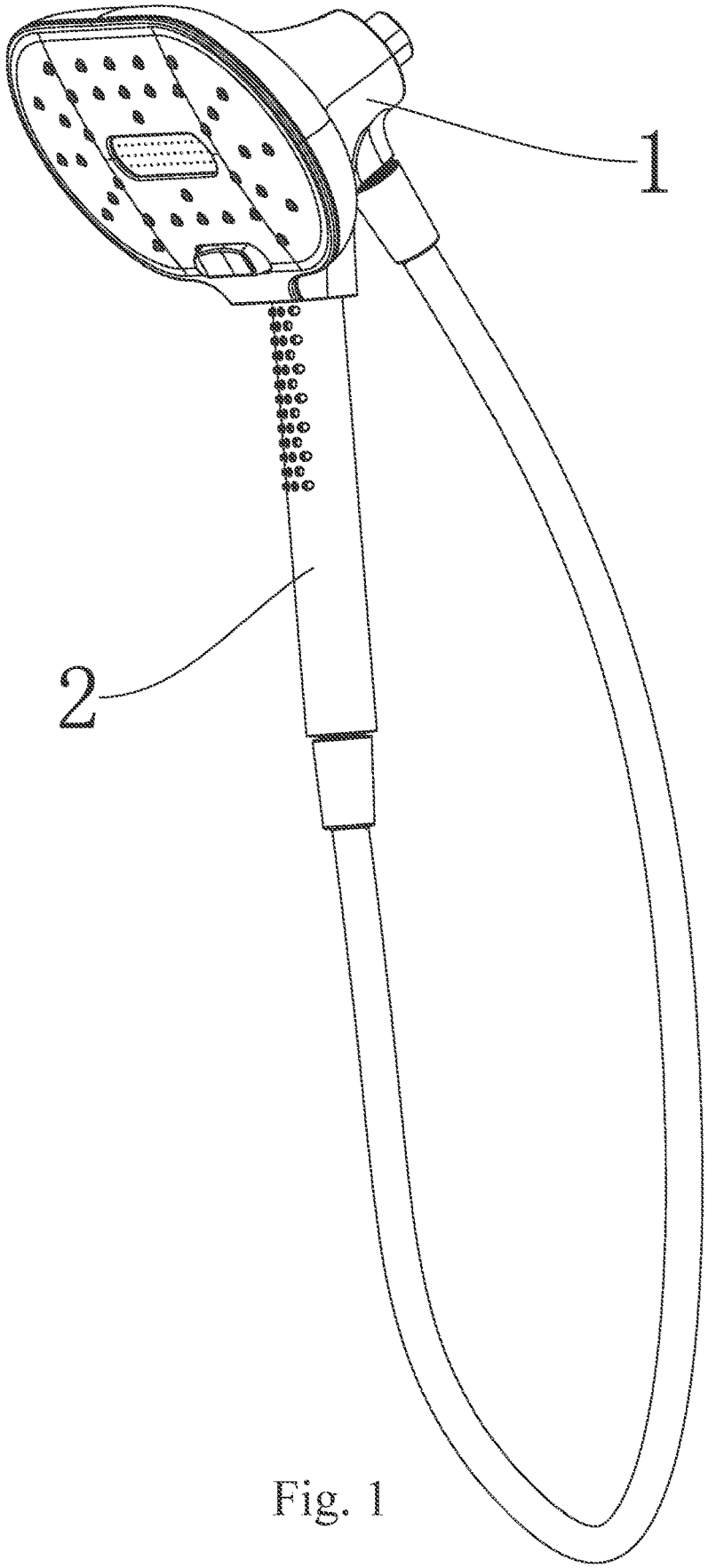
FIG. 1 is a perspective view of an assembled shower device according to the present invention.
Figure 2:
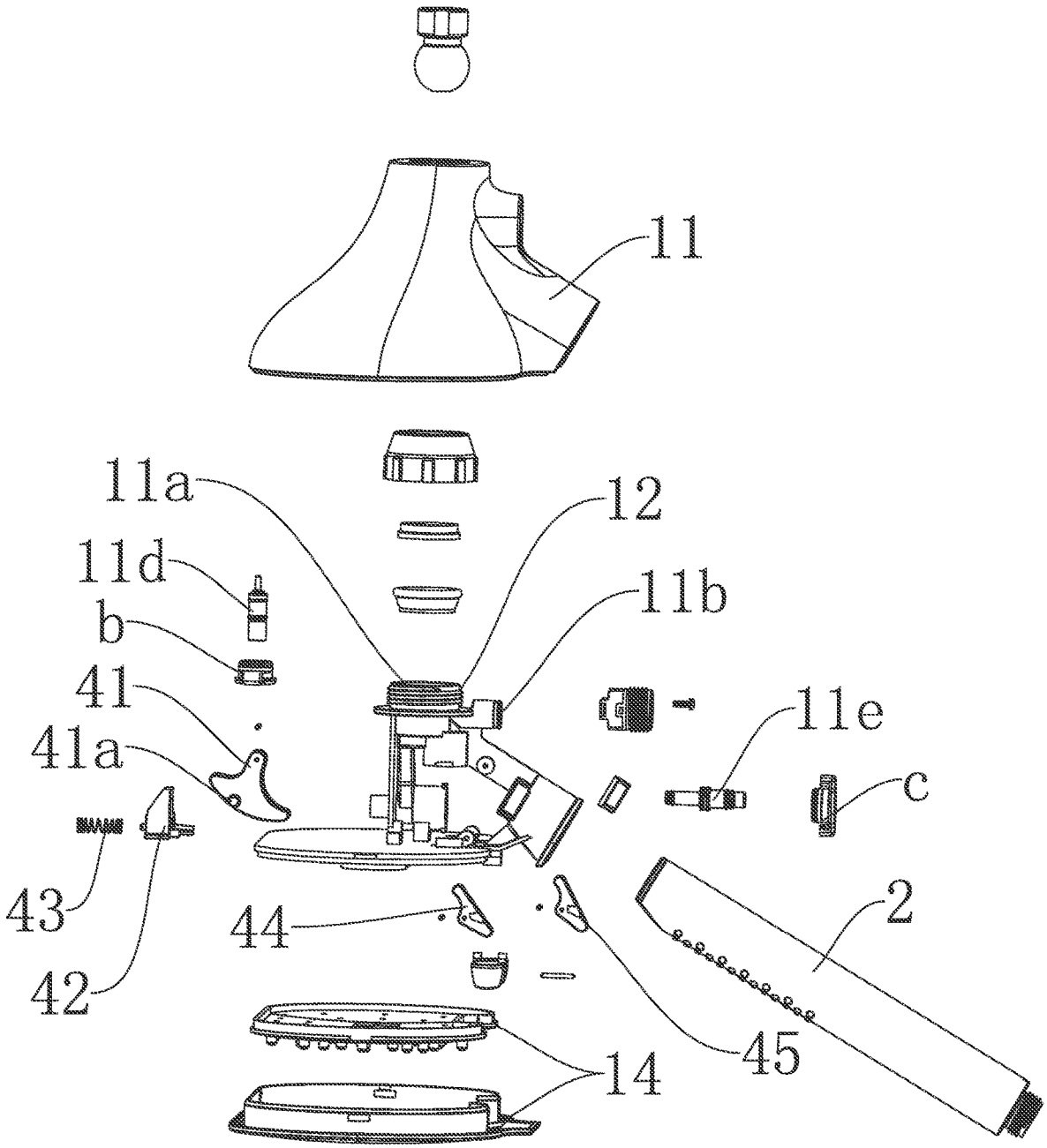
FIG. 2 is an exploded view of an assembled shower device according to the present invention.
Figure 3:
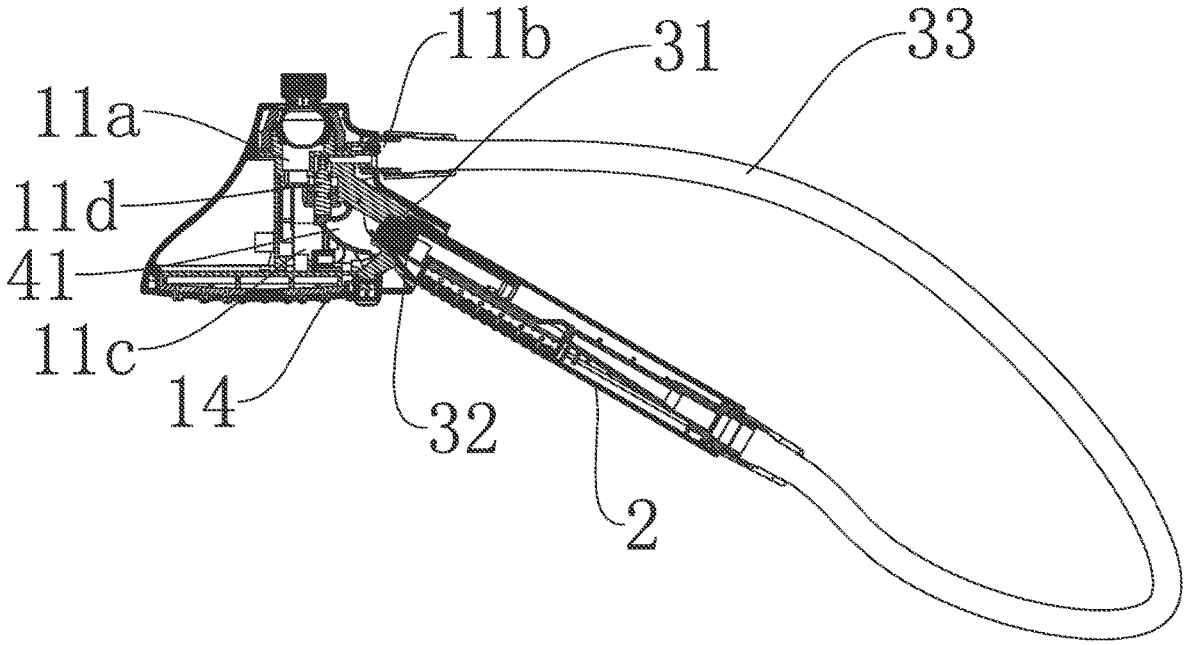
FIG. 3 is a front side cross section view of an assembled shower device according to the present invention.
Figure 4:
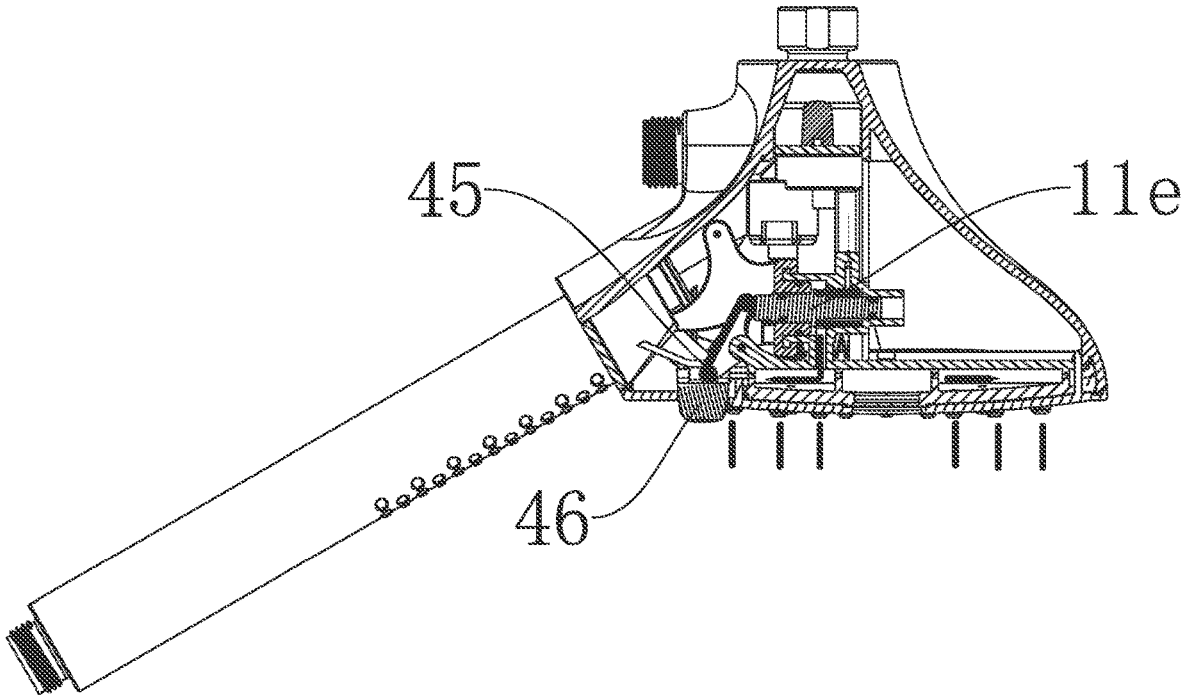
FIG. 4 is a back side cross section view of an assembled shower device according to the present invention.
Figure 5:
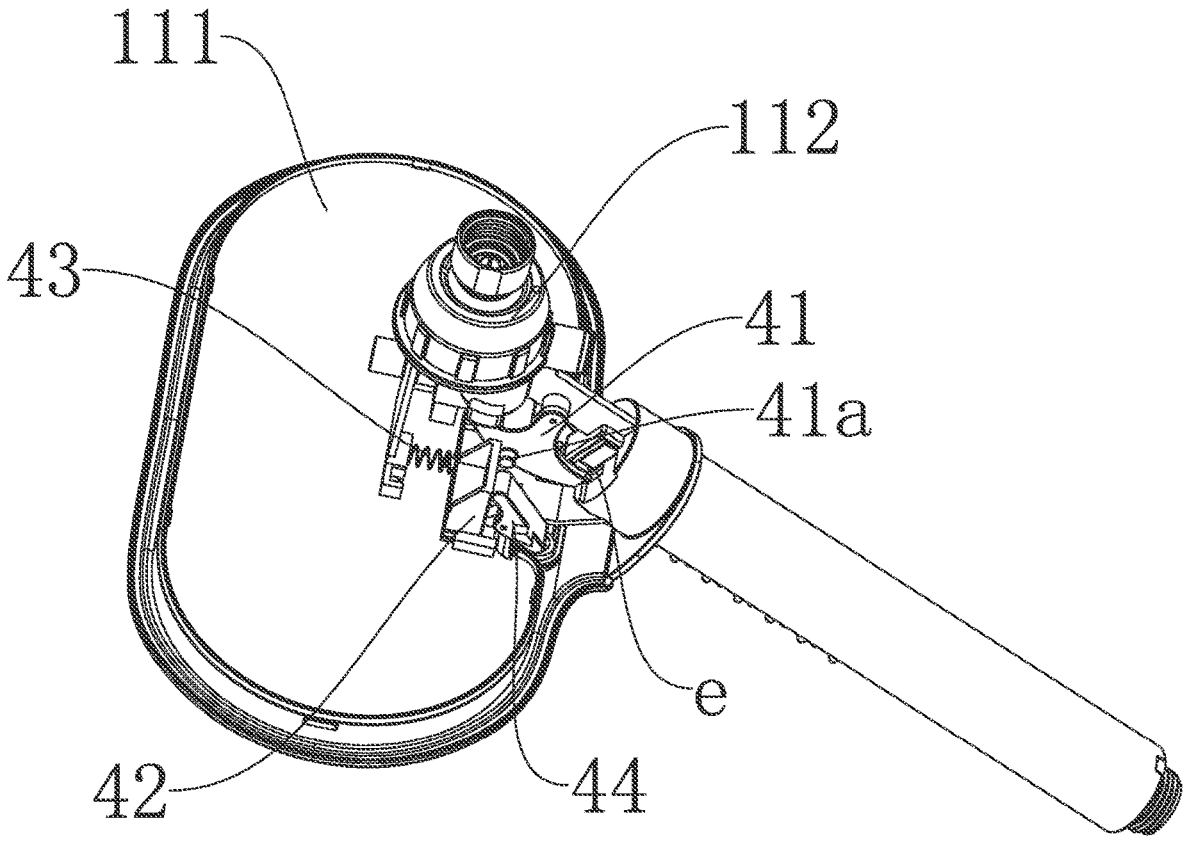
FIG. 5 is a partial perspective view of an assembled shower device according to the present invention.
Figure 6:
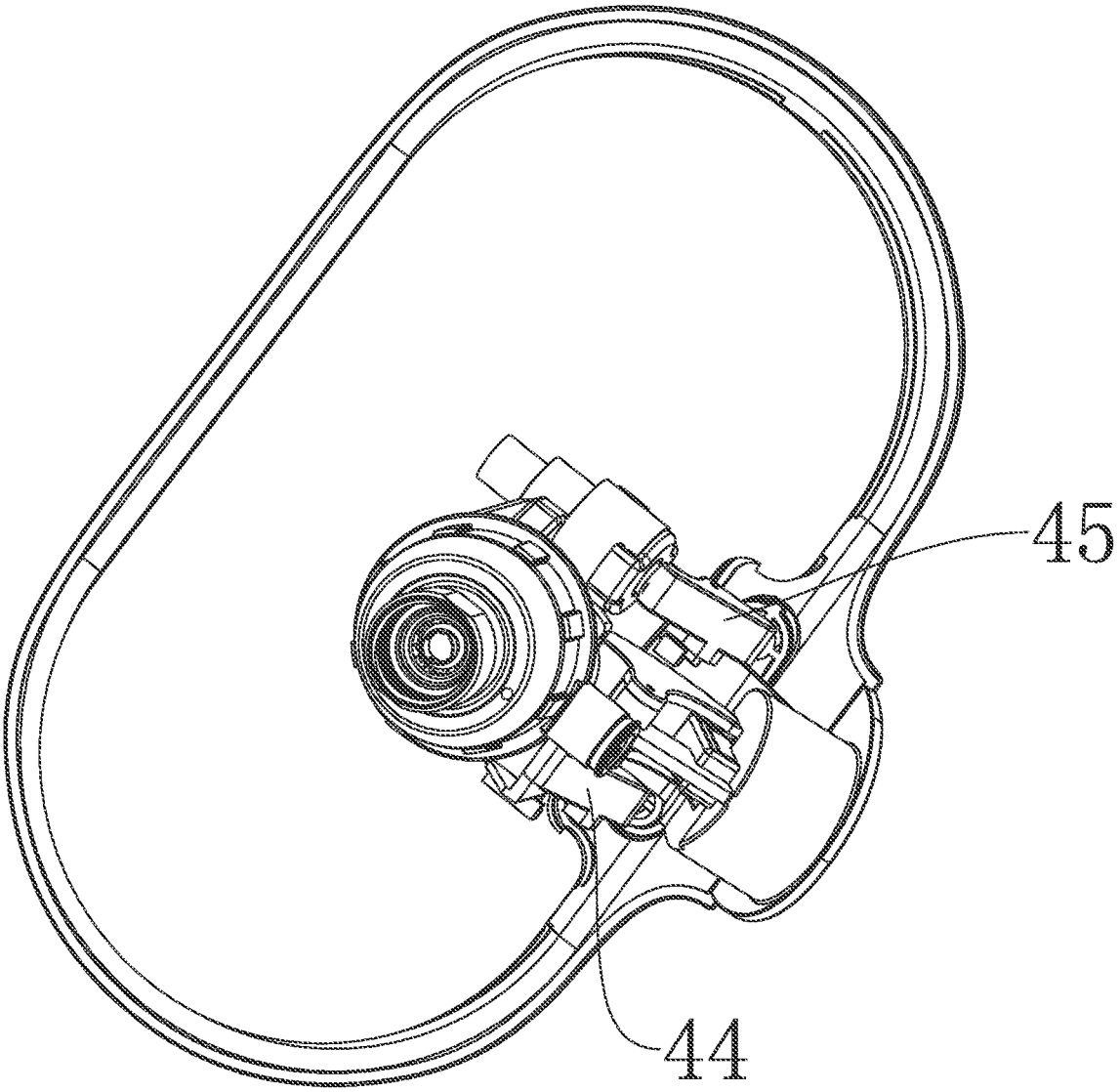
FIG. 6 is a partial top view of an assembled shower device according to the present invention.

The purpose, construction, features, functions and advantages of the present invention can be appreciated and understood more thoroughly through the following detailed descriptions with reference to the attached drawings.

Refer to FIGS. 1 to 9 respectively for a perspective view of an assembled shower device according to the present invention; an exploded view of an assembled shower device according to the present invention; a front side cross section view of an assembled shower device according to the present invention; a back side cross section view of an assembled shower device according to the present invention; a partial perspective view of an assembled shower device according to the present invention; a partial top view of an assembled shower device according to the present invention; a schematic diagram of water output for an assembled shower device in a communication state according to the present invention; a perspective view of an assembled shower device in a separation state according to the present invention; and a schematic diagram of water output for an assembled shower device in a separation state according to the present invention.

As shown in FIGS. 1 to 9, the present invention provides an assembled shower device, that includes a hand-held type shower 2 and a head portion shower 1. In the head portion shower 1 is disposed a control mechanism. The control mechanism is adapted to control open or close of a water channel of the hand-held type shower 2, such that the hand-held type shower 2 and the head portion shower 1 act in cooperation in the following two approaches: the hand-held type shower 2 is disposed on the head portion shower 1, to bring the control mechanism into action, to close the water channel of the hand-held type shower 2; and the hand-held type shower 2 is separated from the head portion shower 1, to bring the control mechanism into action, to open the water channel of the hand-held type shower 2.

To be more specific, the head portion shower 1 includes an outer shell 11, a fixing seat 12, a control mechanism, and a water outlet element 14. Wherein, the control mechanism includes a first switching component and a first magnetic element 31 both disposed in the head portion shower 1. The fixing seat 12 and the control mechanism are disposed in the outer shell 11, the fixing seat 11 includes a bottom seat 111 and a main body 112, and the main body 112 is provided with an insertion slot 113. The first magnetic element 31 is disposed at a position of the main body 112 near the insertion slot 113, with the insertion slot 113 designed for placing the hand-held type shower 2. The second magnetic element 32 is disposed at one end of hand-held type shower 2 near the insertion slot 113. When the first magnetic element 31 and the second magnetic element 32 are made to move close to and attract each other, that will bring the first switching component to control the hand-held type shower 2 not to output water. When the first magnetic element 31 and the second magnetic element 32 are made to separate from each other, that will bring the first switching component to control the hand-held type shower 2 to output water.

Meanwhile, in the main body 112 is disposed a water inlet channel 11*a*, a first water outlet channel 11*b*, and a second water outlet channel 11*c*. The first water outlet channel 11*b* is connected to and in communication with the hand-held type shower 2 through a pliable tube 33, and the second water outlet channel 11*c* is connected to and in communication with the water outlet element 14 to output water. The first switching component includes a first switching valve cartridge 11*d*, a transmission rod 41, a push piece 42, and an elastic piece 43. The first switching valve cartridge 11*d* is disposed between water inlet channel 11*a* and the first water outlet channel 11*b*. The first switching valve cartridge 11*d* is connected to the main body 112 by penetrating through a first fixing cove b in tight seal. The transmission rod 41 is disposed near the first magnetic element 31 on the main body 112 and is rotatable around the main body 112. One side of the transmission rod 41 is leaned against on the first switching valve cartridge 11*d*, to bring the first switching valve cartridge 11*d* to move. Preferably, an indent slot e is disposed on the main body 112, and the other end of the transmission rod 41 is disposed penetrating through the indent slot e, and the indent slot e is adapted to facilitate rotation and positioning of the transmission rod 41. In addition, a protrusion piece 41*a* is disposed on the transmission rod 41, to act in cooperation with the push piece 42. The push piece 42 is also able to restrict the position for the movement of the transmission rod 41.

The push piece 42 is disposed on the bottom seat 111, and a guide rail is disposed at a bottom of the push piece 42, and on the bottom seat 111 is disposed a rail acting in cooperation with the guide rail. One end of the elastic piece 43 is leaned against on the main body 112, the other end of the elastic piece 43 is leaned against on the push piece 42, so that the push piece 42 is made to move reciprocally under action of the elastic piece 43 and the transmission rod 41. Of course, a rotatable first switching rod 44 can be disposed on the bottom seat 111, the first switching rod 44 and the transmission rod 41 are disposed opposite to each other, and are both disposed on a back side of the push piece 42.

The assembled shower device further includes a second switching component, the second switching component includes a second switching valve cartridge 11*e*, a second switching rod 45, and a push button 46. The second switching valve cartridge 11*e* is disposed between the water inlet channel 11*a* and the second water outlet channel 11*c*. The second switching valve cartridge 11*e* is connected to the main body 112 through a second fixing cover c in tight seal.

The second switching rod 45 is disposed on the bottom seat 111, with one end of the second switching rod 45 leans against on the second switching valve cartridge 11*e*. The push bottom 46 is connected to the second switching rod 45. When the push button 46 is pressed, it brings the second switching rod 45 into rotation, and the second switching rod 45 brings the second switching valve cartridge 11*e* to close or open the second water outlet channel 11*c*, to not output water or output water.

Figure 7:
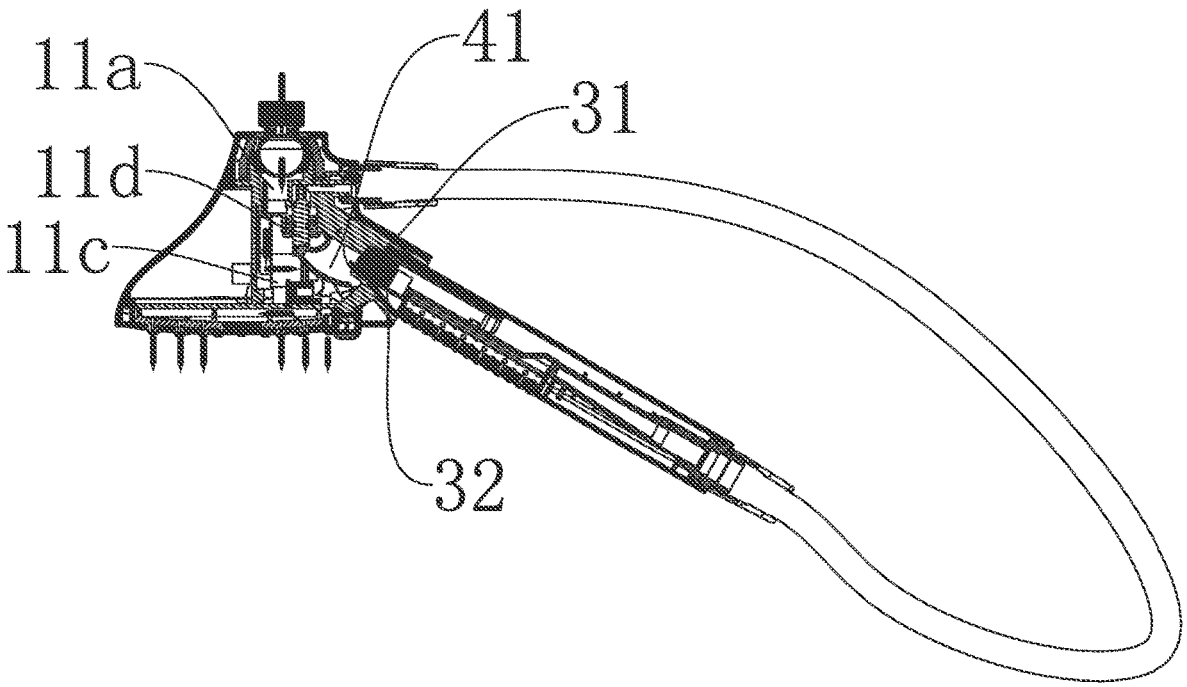
FIG. 7 is a schematic diagram of water output for an assembled shower device in a communication state according to the present invention.
Figure 8:
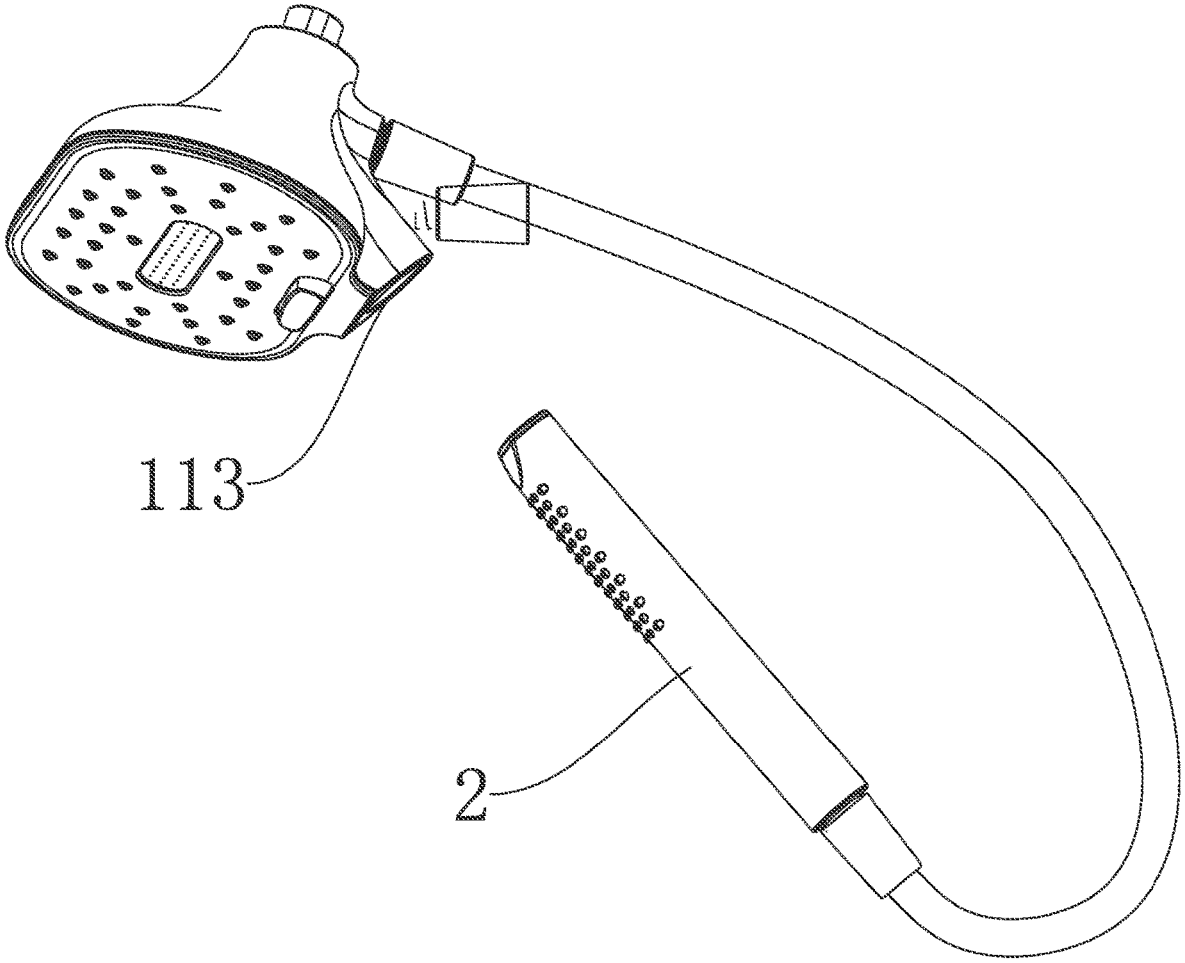
FIG. 8 is a perspective view of an assembled shower device in a separation state according to the present invention.
Figure 9:
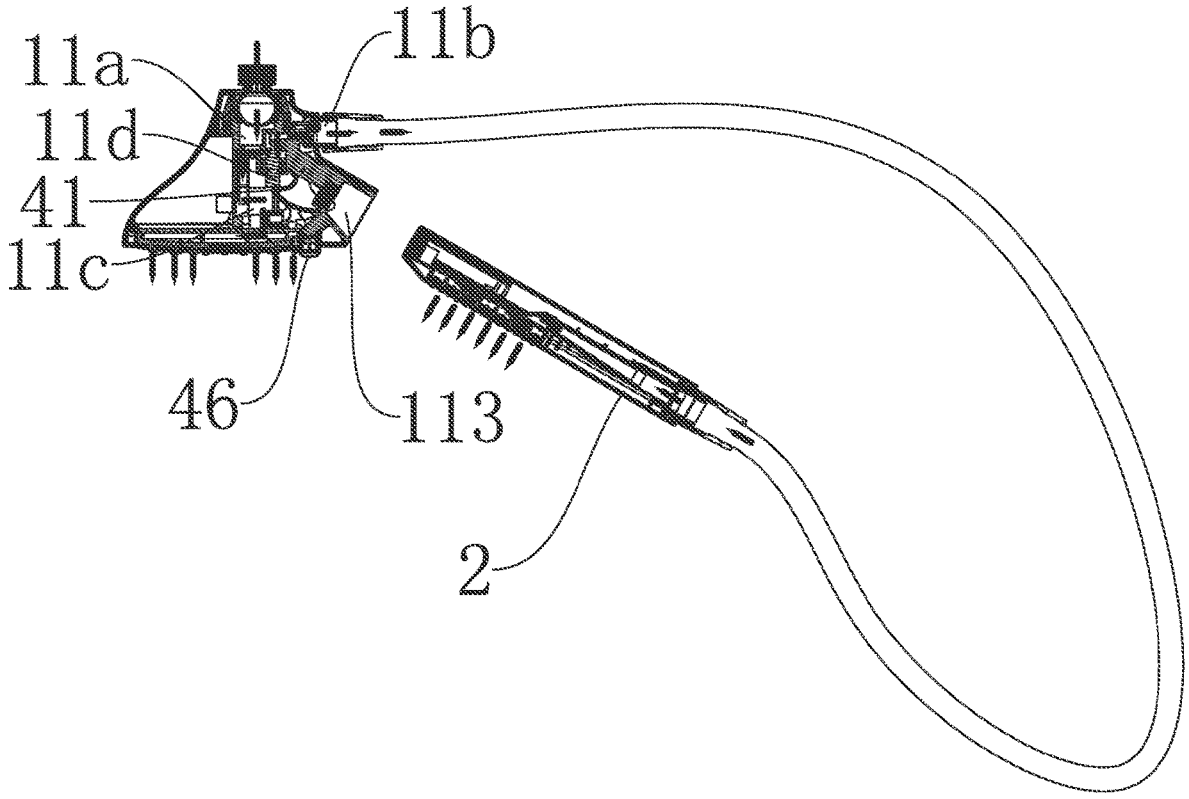
FIG. 9 is a schematic diagram of water output for an assembled shower device in a separation state according to the present invention.

As such, when the water channel is opened, and when the hand-held type shower 2 is placed into the head portion shower 1, the first magnetic element 31 and the second magnetic element 32 act in cooperation. At this time, the attraction force of the two magnetic elements is greater than the elastic force of the elastic piece 43, such that the transmission rod 41 pushes the push piece 42 through the protrusion piece 41*a* to overcome the elastic force of the elastic piece 43, to swing upward. That in turn exerts force on the first switching valve cartridge 11*d*, to push it to move upward, so that first switching valve cartridge 11*d* block the connection and communication between the water inlet channel 11*a* and the first water outlet channel 11*b*. At this time, the water inlet channel 11*a* is only connected and in communication with the second water outlet channel 11*c*, to make water output from the water outlet element 14. In other words, at this time, water is output from the head portion shower 1 but water is not output from the hand-held type shower 2 (as shown in FIG. 7). When the hand-held type shower 2 is taken off from the insertion slot 113 of the head portion shower 1 (as shown in FIG. 8), such that the magnetic attraction force disappears, and the elastic piece 43 push the push piece 42 to move along the rail of the bottom seat 111, to bring the transmission rod 41 back to its original position. As such, the first switching valve cartridge 11*d* is moved downward, the water inlet channel 11*a* is connected and in communication with the first water outlet channel 11*b*, such that water flows out from the water inlet channel 11*a* through the first water outlet channel 11*b* and the second water outlet channel 11*c*. In other words, water flows out from both the head portion shower 1 and the hand-held type shower 2 automatically (as shown in FIG. 9). When water flows out from the head portion shower 1 and the hand-held type shower 2 simultaneously, since a push button 46 is disposed on the head portion shower 1, such that in case the user desires to open or close water output form the head portion shower 1, all the user has to do is to press the push button 46, to bring the second switching rod 45 to push the second switching valve cartridge 11*e* to close or open the connection and communication between the water inlet channel 11*a* and the second water outlet channel 11*c*. Further, when the head portion shower 1 is closed, water can be output from the head portion shower 1 by placing the hand-held type shower 2 into the insertion slot 113.

In the present invention, for the assembled shower device, the hand-held type shower 2 can be placed onto or taken off the head portion shower 1, to control water to output from the hand-held type shower 2 automatically, without the need for the user to perform switching manually. As such, the design of the present invention is capable of simplifying operations and applications, increasing user's satisfaction. Moreover, in the present invention, a push button is provided, to enable water output from the head portion shower 1, hereby providing enormous convenience to the user.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. An assembled shower device, comprising: a hand-held shower; a head portion shower, in which is disposed a control mechanism, the control mechanism is adapted to control open or close of a water channel of the hand-held shower, such that the hand-held shower and the head portion shower act in cooperation in the following two approaches: (1) the hand-held shower is disposed on the head portion shower, to bring the control mechanism into action, to close the water channel of the hand-held shower, and (2) the hand-held shower is separated from the head portion shower, to bring the control mechanism into action, to open the water channel of the hand-held shower, wherein the control mechanism includes a first switching component and a first magnetic element disposed in the head portion shower, and a second magnetic element is disposed at one end of the hand-held shower, such that the first magnetic element and the second magnetic element are made to separate apart or move close, to bring the first switching component to open or close the water channel of the hand-held shower; wherein the head portion shower further includes an outer shell, a fixing seat, and a water outlet element, the fixing seat and the control mechanism are disposed in the outer shell, the fixing seat includes a bottom seat and a main body, the main body is provided with an insertion slot, and the first magnetic element is disposed at a position of the main body adjacent the insertion slot, and the second magnetic element is disposed at one end of hand-held shower adjacent the insertion slot; wherein in the main body is disposed a water inlet channel, a first water outlet channel, and a second water outlet channel, the first water outlet channel is connected and in communication with the hand-held shower, the second water outlet channel is connected and in communication with the water outlet element; wherein the first switching component includes a first switching valve cartridge, a transmission rod, a push piece, and an elastic piece, the first switching valve cartridge is disposed between water inlet channel and the first water outlet channel; the transmission rod is disposed adjacent the first magnetic element and is rotatable around the main body, one side of the transmission rod is leaned against on the first switching valve cartridge; one end of the elastic piece is leaned against on the main body, the other end of the elastic piece is leaned against on the push piece, the push piece is disposed on the bottom seat, the push piece is made to move reciprocally under action of the elastic piece and the transmission rod; and a second switching component, the second switching component includes a second switching valve cartridge, a second switching rod, and a push button, the second switching valve cartridge is disposed between the water inlet channel and the second water outlet channel, the second switching rod is disposed on the bottom seat, with one end of the second switching rod leans against on the second switching valve cartridge, the push bottom is connected to the second switching rod, when the push button is pressed, it brings the second switching rod into rotation.

2. The assembled shower device as claimed in claim 1, wherein a protrusion piece is disposed on the transmission rod, and the protrusion piece act in cooperation with the push piece.

3. The assembled shower device as claimed in claim 1, wherein a guide rail is disposed at a bottom of the push piece, and on the bottom seat is disposed a rail acting in cooperation with the guide rail.

4. The assembled shower device as claimed in claim 1, wherein on the bottom seat is disposed a rotatable first switching rod, the first switching rod and the transmission rod are disposed opposite to each other, and are both disposed on a back side of the push piece.

* * * * *